US012522466B2

(12) United States Patent
Rhyne et al.

(10) Patent No.: US 12,522,466 B2
(45) Date of Patent: Jan. 13, 2026

(54) POWERED CREEL SYSTEMS, RECEIVER APPARATUSES AND RELATED METHODS FOR YARN PACKAGES

(71) Applicant: Belmont Textile Machinery Company, Mount Holly, NC (US)

(72) Inventors: Jeffrey Todd Rhyne, Belmont, NC (US); Daniel Arthur Rhyne, Gastonia, NC (US)

(73) Assignee: Belmont Textile Machinery Company, Mount Holly, NC (US)

( * ) Notice: Subject to any disclaimer, the term of this patent is extended or adjusted under 35 U.S.C. 154(b) by 0 days.

(21) Appl. No.: 18/248,798

(22) PCT Filed: Mar. 23, 2023

(86) PCT No.: PCT/US2023/064869

§ 371 (c)(1),
(2) Date: Apr. 12, 2023

(87) PCT Pub. No.: WO2023/183878

PCT Pub. Date: Sep. 28, 2023

(65) Prior Publication Data

US 2025/0002290 A1 Jan. 2, 2025

Related U.S. Application Data

(60) Provisional application No. 63/323,120, filed on Mar. 24, 2022.

(51) Int. Cl.

| | |
|---|---|
| ***B65H 49/16*** | (2006.01) |
| ***B65H 49/12*** | (2006.01) |
| ***B65H 67/02*** | (2006.01) |

(52) U.S. Cl.

CPC ..... *B65H 49/16* (2013.01); *B65H 49/12* (2013.01); *B65H 67/02* (2013.01); *B65H 2701/31* (2013.01)

(58) Field of Classification Search

CPC ..... B65H 67/02; B65H 49/12; B65H 49/16; B65H 49/06; B65H 2701/31

See application file for complete search history.

(56) References Cited

U.S. PATENT DOCUMENTS 2,615,652 A * 10/1952 Elwood ..... D02H 1/00 242/130
2,704,643 A * 3/1955 Lambach ..... B65H 49/06 242/130.1

(Continued)

FOREIGN PATENT DOCUMENTS

EP 3771673 A1 * 2/2021 ..... B65H 49/20
WO WO-2018146582 A1 * 8/2018 ..... B65H 59/388

OTHER PUBLICATIONS

International Search Report and Written Opinion Issued for Corresponding PCT/US2023/064869 dated Sep. 8, 2023, 20 pages.

(Continued)

*Primary Examiner* — Anna M Momper
*Assistant Examiner* — Katelynne R Burrell
(74) *Attorney, Agent, or Firm* — Shumaker, Loop & Kendrick, LLP

(57) ABSTRACT

Apparatuses, systems and methods include support brace(s), one or more of which are configured to support a receiver apparatus relative to a frame and define an opening that is configured to receive and orient a post along a vertical axis. A stator element coupled to one or more of the support brace(s) is rotationally fixed relative to the one or more support brace(s) about the vertical axis. A rotor element is configured to pivot about the vertical axis and includes a base and a package holder. The package holder includes a proximal end, a distal end, and an elongated body therebetween. The proximal end is coupled to base such that the elongated body extends at least partially in a radial direction relative to the vertical axis. The actuator is configured to (Continued)

receive an activation signal and pivot the rotor element relative to the stator element about the vertical axis.

8 Claims, 11 Drawing Sheets

(56) References Cited

U.S. PATENT DOCUMENTS 3,556,370 A * 1/1971 Strozewski ..... B21C 47/20 242/593
3,915,406 A * 10/1975 Rolli ..... B65H 49/16 242/131
3,949,946 A * 4/1976 Rohner ..... B65H 67/02 242/485.9
4,226,567 A * 10/1980 Van Orsdale, Jr. .. B65H 67/065 414/733
4,298,174 A * 11/1981 Kovaleski ..... B65H 49/12 242/128
4,591,105 A * 5/1986 Niederer ..... B65H 67/04 242/473.5
RE33,111 E * 11/1989 Niederer ..... B65H 67/04 242/473.5
4,880,184 A * 11/1989 Crow ..... B65H 49/06 242/130
5,944,272 A * 8/1999 Comotto ..... D02H 1/00 242/130.4
6,345,783 B1 * 2/2002 Worner ..... D04B 15/42 403/258
7,802,749 B2 * 9/2010 Chadwick ..... B65H 57/04 242/131
7,806,360 B2 * 10/2010 Chadwick ..... B65H 49/16 242/131
7,866,595 B2 * 1/2011 Chadwick ..... B65H 49/16 242/131
7,971,822 B1 * 7/2011 Crow ..... B65H 49/16 242/593
9,475,668 B2 * 10/2016 Barea ..... B65H 49/12
9,604,816 B2 * 3/2017 Ersurmeli ..... B65H 49/16
9,617,111 B2 * 4/2017 Hoover ..... D01H 1/18
10,934,125 B2 * 3/2021 Eaton ..... B65H 49/12
2007/0215742 A1 9/2007 Zollinger
2008/0173742 A1 7/2008 Chadwick
2009/0067971 A1 * 3/2009 Chadwick ..... B65H 67/065 414/680
2009/0101749 A1 * 4/2009 Chadwick ..... B65H 57/06 242/131
2015/0225203 A1 * 8/2015 Hoover ..... D04B 15/42 242/131
2015/0291383 A1 * 10/2015 Barea ..... D02H 1/00 242/564
2016/0229657 A1 * 8/2016 Ersurmeli ..... B65H 49/16
2020/0026267 A1 1/2020 Morton et al.
2020/0031608 A1 1/2020 Kurtz et al.

OTHER PUBLICATIONS

International Preliminary Report on Patentability issued on Oct. 3, 2024, in corresponding International Application No. PCT/US2023/064869 (10 pages).

* cited by examiner

POWERED CREEL SYSTEMS, RECEIVER APPARATUSES AND RELATED METHODS FOR YARN PACKAGES

CROSS-REFERENCE TO RELATED APPLICATIONS

This application is a United States 371 national stage application tracing priority to and claiming benefit of Patent Cooperation Treaty (PCT) Application No. PCT/US23/64869 filed Mar. 23, 2023, entitled Power Creel Systems, Receiver Apparatuses and Related Methods for Yarn Packages, which traces priority to and claims benefit of U.S. Provisional Patent Application No. 63/323,120 filed on Mar. 24, 2022 entitled Powered Receiver Apparatus for a Yarn Package, the entire contents of both of which are hereby expressly incorporated herein by reference.

TECHNICAL FIELD

One or more aspects of the present disclosure broadly relates to yarn package receivers used in textile processes and, more particularly, to powered or automated yarn package receivers.

BACKGROUND

Creels are generally used for supporting multiple packages of yarn, such as in spools, during use in a textile process or yarn processing. A creel may include receiver arms to hold each of the spools in use. Yarn packages are typically provided on a core, such a tube, with a yarn thread suitable for the textile operation wound around the core. Some receiver arms are rotatable from a use position to a load position that makes replacement of empty yarn packages and/or cores easier for operators. However, operators are required to manually turn the receiver arm or manually power a system to do the same. Due to the size and weight of many yarn packages, the effort required to rotate the receiver arm can cause undesirable strain and fatigue on operators and may even result in operator injury. Further, there is a desire to use larger yarn packages in textile operations, which allows for greater efficiencies and a more continuous textile process. However, the stress, strain, and fatigue on operators increases with the weight and size of the yarn packages. Generally, processes requiring extensive human labor may also result in reduced productivity and increased processing costs.

As such, a need exists in the art for an improved receiver arm for yarn packages that overcomes the above limitations.

SUMMARY

The following discussion discloses and describes an improved creel systems, receiver apparatuses, assemblies, arrangements, configurations and related methods that overcome the limitations of the known art. To achieve the foregoing and other objects and advantages, in one aspect, the present subject matter is directed to a receiver apparatus for a package, the receiver apparatus comprises: at least one support brace, one or more braces of the at least one support brace defining an opening, the one or more braces configured to support the receiver apparatus relative to a frame and wherein the opening is configured to receive a post and orient the post generally along a vertical axis; a stator element coupled to one or more braces of the at least one support brace such that the stator element is rotationally fixed relative to the one or more braces about the vertical axis; a rotor element configured to pivot about the vertical axis and comprising a base and a package holder, the package holder including a proximal end, a distal end, and an elongated body therebetween, wherein the proximal end is coupled to the base such that the elongated body extends at least partially in a radial direction relative to the vertical axis; and an actuator configured to receive an activation signal and to pivot the rotor element relative to the stator element about the vertical axis.

In one embodiment, the actuator of the receiver apparatus comprises at least one of a pneumatic actuator, a hydraulic actuator, or an electric actuator.

In one embodiment, the package of the receiver apparatus comprises a yarn package, wherein the receiver apparatus further comprises a replacement sensor configured, in use, to detect a level of yarn remaining on the yarn package and communicate a level signal associated with the level of yarn remaining on the yarn package, the yarn package being coupled to the package holder.

In one embodiment, the package of the receiver apparatus comprises a yarn package, the receiver apparatus further comprising a controller communicatively coupled to a replacement sensor, the controller configured, in use, to receive a level signal communicated by the replacement sensor indicating a level of yarn remaining on the yarn package, and based thereon compare the level of yarn remaining on the yarn package to a predetermined level, and further configured to communicate, based on the level of yarn remaining on the yarn package being determined to be below the predetermined level, a replacement signal.

In one embodiment, the package of the receiver apparatus comprises a yarn package, and wherein a controller is communicatively coupled to the actuator, and wherein the controller is configured, in use, to communicate an activation signal to the actuator.

In one embodiment, the package of the receiver apparatus comprises a yarn package, the receiver apparatus further comprising a replacement indicator communicatively coupled to the controller, wherein the replacement indicator is configured, in use, to receive a replacement signal communicated by the controller and based thereon to transmit an alert that the level of yarn remaining on the yarn package has fallen below a predetermined level.

In an additional or alternative aspect, the present subject matter is directed to a creel system utilized for supporting packages and defining a vertical axis of rotation, the creel system comprising: a frame that includes a plurality of frame members; a post retained relative to the frame; and a receiver apparatus configured to retain a package, the receiver apparatus comprising at least one support brace coupled to the frame such that the receiver apparatus is supported, via one or more braces of the at least one support brace, relative to the frame, the one or more braces defining an opening circumscribing the post such that the post is generally oriented along the vertical axis; a stator element coupled to the one or more braces such that the stator element is rotationally fixed relative to the one or more brace about the vertical axis; a rotor element pivotable about the post and comprising a base and a package holder, the package holder including a proximal end, a distal end, and an elongated body therebetween, wherein the proximal end is coupled to the base such that the elongated body extends at least partially in a radial direction relative to the vertical axis; and an actuator configured to receive an activation signal and pivot the rotor element relative to the stator element about the vertical axis.

In one embodiment, the actuator of the creel system comprises at least one of a pneumatic actuator, a hydraulic actuator, or an electric actuator.

In one embodiment, the package of the creel system comprises a yarn package, and wherein the creel system further comprises a replacement sensor coupled to the frame and configured, in use, to detect a level of yarn remaining on the yarn package and communicate a level signal associated with the level of yarn remaining on the yarn package, the yarn package being coupled to the package holder.

In one embodiment, the package of the creel system comprises a yarn package, the creel system further comprising a controller communicatively coupled to a replacement sensor, the controller configured, in use, to receive a level signal communicated by the replacement sensor indicating a level of yarn remaining on the yarn package, and based thereon compare the level of yarn remaining on the yarn package to a predetermined level, and further configured to communicate, based on the level of yarn remaining on the yarn package being determined to be below the predetermined level, a replacement signal.

In one embodiment, the package of the creel system comprises a yarn package, and wherein the controller is communicatively coupled to the actuator, and wherein the controller is configured, in use, to communicate an activation signal to the actuator.

In one embodiment, the package of the creel system comprises a yarn package, the creel system further comprises a replacement indicator communicatively coupled to the controller, wherein the replacement indicator is configured, in use, to receive a replacement signal and based thereon to transmit an alert that the level of yarn remaining on the yarn package has fallen below the predetermined level.

In one aspect, the present invention is directed to a method of using a receiver apparatus of a creel system, the method comprising: detecting, via a sensor, a level of yarn remaining on a yarn package coupled to the receiver apparatus, and based thereon communicating a level signal associated with the level of yarn to a controller; comparing, via the controller, the level of yarn remaining on the yarn package to a predetermined level and based thereon determining that the level of yarn is below the predetermined level; and communicating, via the controller and based on determining the level of yarn remaining on the yarn package is below the predetermined level, a replacement signal to a replacement indicator that is communicatively coupled to the controller, wherein the replacement indicator is configured to transmit an alert.

In one embodiment, the method further comprises: transmitting, via the replacement indicator, the alert to an operator to remove a core of the yarn package from the receiver apparatus; and receiving a first input from an operator and based thereon communicating a first activation signal to an actuator of the receiver apparatus to facilitate biasing a rotor element toward a load position.

In one embodiment, the method further comprises receiving a second input from an operator and based thereon communicating a second activation signal to an actuator of the receiver apparatus to facilitate biasing a rotor element toward a use position, wherein the input is received after the operator has coupled a new yarn package to the receiver apparatus.

In one embodiment, the method further comprises communicating, via a controller and based on the replacement indicator receiving the replacement signal, a first activation signal to an actuator of the receiver apparatus, and based thereon vertically translating a stator element of the receiver apparatus in a first direction along an axis of rotation defined by the creel system, the translating causing rotation of a rotor element that comprises a package holder, the rotor element rotating about a post from a use position to a load position thereby biasing a package holder from the use position to the load position.

In one embodiment, the method further comprises transmitting, via the replacement indicator, the alert to an auto-loader system, wherein the auto-loader system is configured to remove the yarn package from the receiver apparatus and couple a new yarn package to the receiver apparatus.

In one embodiment, the method further comprises: removing, via an auto-loader system and based on the alert being transmitted to the auto-loader system and a rotor element biasing toward a load position, the yarn package coupled to the receiver apparatus; and loading, via the auto-loader, a new yarn package onto the receiver apparatus.

In one embodiment, the method further comprises: based on an auto-loader loading a new yarn package onto the receiver apparatus, communicating, via a controller, a second activation signal to an actuator of the receiver apparatus; andvertically translating a stator element of the receiver apparatus in a second direction along an axis of rotation defined by the creel system, the translating causing rotation of a rotor element that comprises a package holder to bias toward a use position, the package holder being coupled to the new yarn package.

In one embodiment, the method further comprises: vertically translating a stator element of the receiver apparatus along an axis of rotation defined by the creel system, the translating causing rotation of a rotor element that comprises a package holder; and wherein translating the stator element in a first direction causes the rotor element to bias toward a load position, and wherein translating the stator element in a second direction opposite the first direction causes the rotor element to bias toward a use position.

Embodiments of the inventive concepts can include one or more or any combination of the above aspects, features, and configurations. Additional features, aspects, and advantages of the invention will be set forth in the detailed description that follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

One or more aspects of the invention are particularly pointed out and distinctly claimed as examples in the claims at the conclusion of the specification. The foregoing and other objects, features, and advantages of one or more aspects are apparent from the following detailed description taken in conjunction with the accompanying drawings, which are not necessarily to scale an in which some features may be exaggerated and some features may be omitted or may be represented schematically in the interest of clarity. In the drawings:

Like reference numerals in the drawings may represent and refer to the same, analogous, or similar elements, features, or functions.

DETAILED DESCRIPTION OF THE EMBODIMENTS

Figure 1:
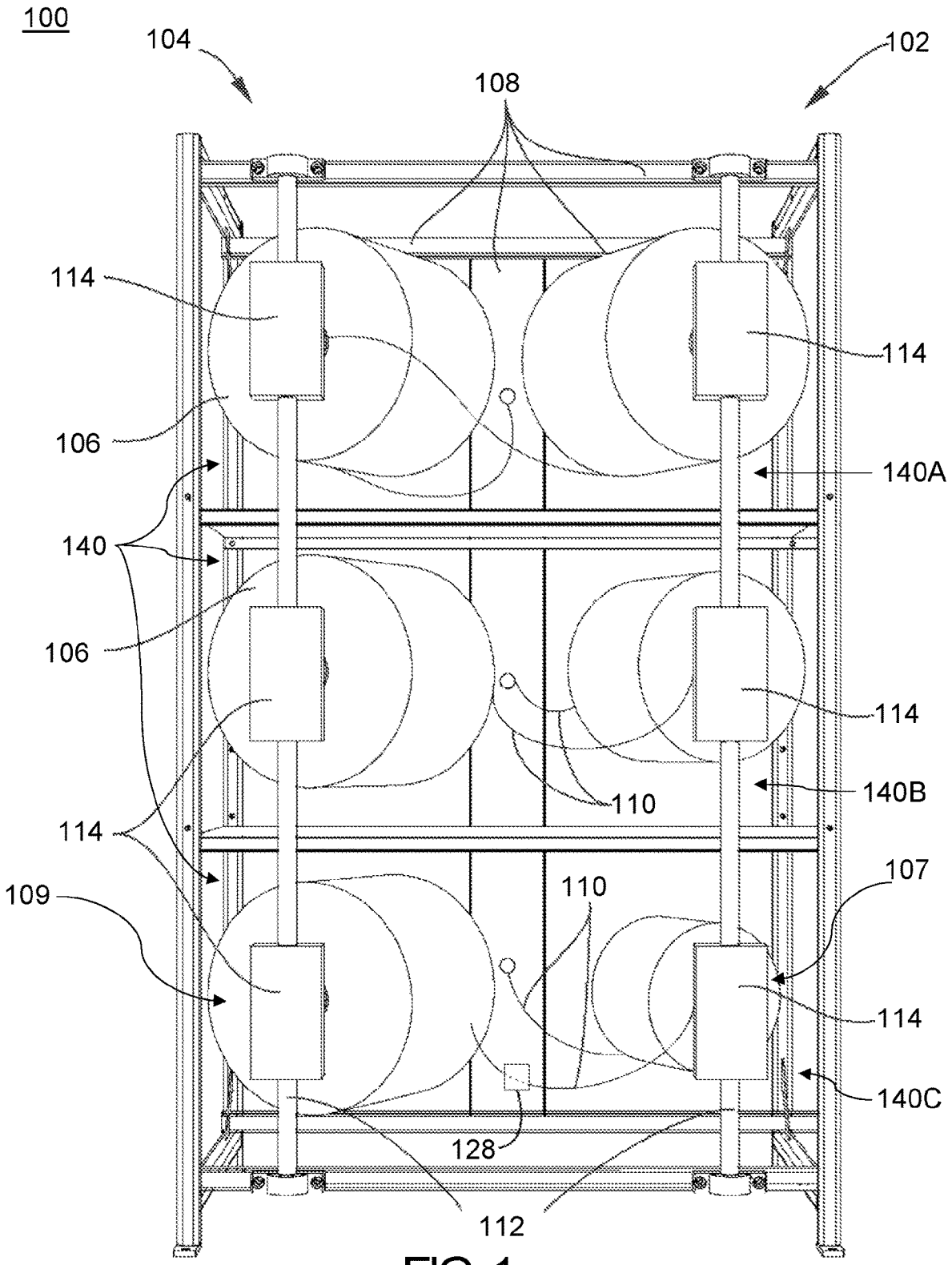
FIG. 1 depicts a rear perspective view an example environment of a creel system that includes receiver apparatuses for yarn packages, according to one embodiment.

The following detailed description and appended drawings describe and illustrate various exemplary embodiments of the disclosure. The description and drawings serve to enable one skilled in the art to make and use the disclosure, and are not intended to limit the scope of the disclosure in any manner.

Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. It is envisioned that other embodiments may perform similar functions and/or achieve similar results. Any and all such equivalent embodiments and examples are within the scope of the present invention and are intended to be covered by the appended claims. With respect to the methods disclosed, the steps presented are exemplary in nature, and thus, the order of the steps is not necessary or critical.

The terms "coupled," "fixed," "attached to," "communicatively coupled to" "connected" and the like refer to both direct coupling, fixing, attaching, communicatively coupling as well as indirect coupling, fixing, attaching, communicatively coupling via one or more intermediate components or features, unless otherwise specified herein.

"A" and "an" as used herein indicate "at least one" of the item is present; a plurality of such items may be present, when possible. Spatially relative terms, such as "front," "rear," "back," "top," "bottom," "vertical," "upper," "lower," "side," "above," "below," "beneath," and the like may be used herein for ease of description to describe one element or feature's relationship to another element(s) or feature(s) as illustrated in the figures. Spatially relative terms may be intended to encompass different orientations of the device in use or operation in addition to the orientation depicted in the figures.

It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

As used herein, substantially is defined as "to a considerable degree" or "proximate" or as otherwise understood by one ordinarily skilled in the art or as otherwise noted. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially"

as used herein indicates at least variations that may arise from ordinary methods of measuring or using such parameters.

Where any conflict or ambiguity may exist between a document incorporated by reference and this detailed description, the present detailed description controls. Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context.

The inventive concepts disclosed herein are generally directed to a receiver apparatus, associated creel systems (e.g., for use in textiles, carpets, and the like), and associated methods for using, restocking, and retrofitting the same. In an exemplary embodiment, a creel system including various embodiments of the disclosed receiver apparatus may reduce the strain on the operators of the same. For example, by reducing the distance an operator is required to rotate/lift/move a full yarn package to replace an empty yarn package core, work place accidents may be reduced as well as the fatigue of operators of associated creel systems.

For example, the embodiments of the receiver apparatus may include a bracket to support the receiver relative to a frame and/or creel support. A package holder generally extends radially away from a generally vertical post (e.g., an axle) to a distal end and is configured to retain and hold a yarn package during various textile processes. The package holder extends from a base rotatably coupled to the axle so that an empty or nearly empty yarn package core may be rotated to make replacement easier. Particularly, various embodiments of the disclosed receiver apparatus include an actuator configured to and suitable to cause rotation of the package holder/yarn package. Particularly, the actuator may be powered such that the package holder pivots about the axle without the need for an operator to rotate the package holder by hand and, thus, reduce the strain and/or fatigue experienced by creel operators.

In some embodiments, an operator may push a button to cause the actuator to rotate the package holder to a load position. Some embodiments may include a replacement sensor and associated controller that notifies an operator of an associated creel that the yarn package is empty, depleted, nearly empty, or the like (e.g., leaving the core remaining). In further or alternative embodiments, the controller may automatically rotate the package holder to the load position when the associated yarn package requires replacement. The creel system may further include an autonomous reloader configured to replace an empty yarn package core with a new yarn package, e.g., when the package holder is in the load position. Thus, the need for the operator to handle the yarn packages may be entirely eliminated.

Figure 2:
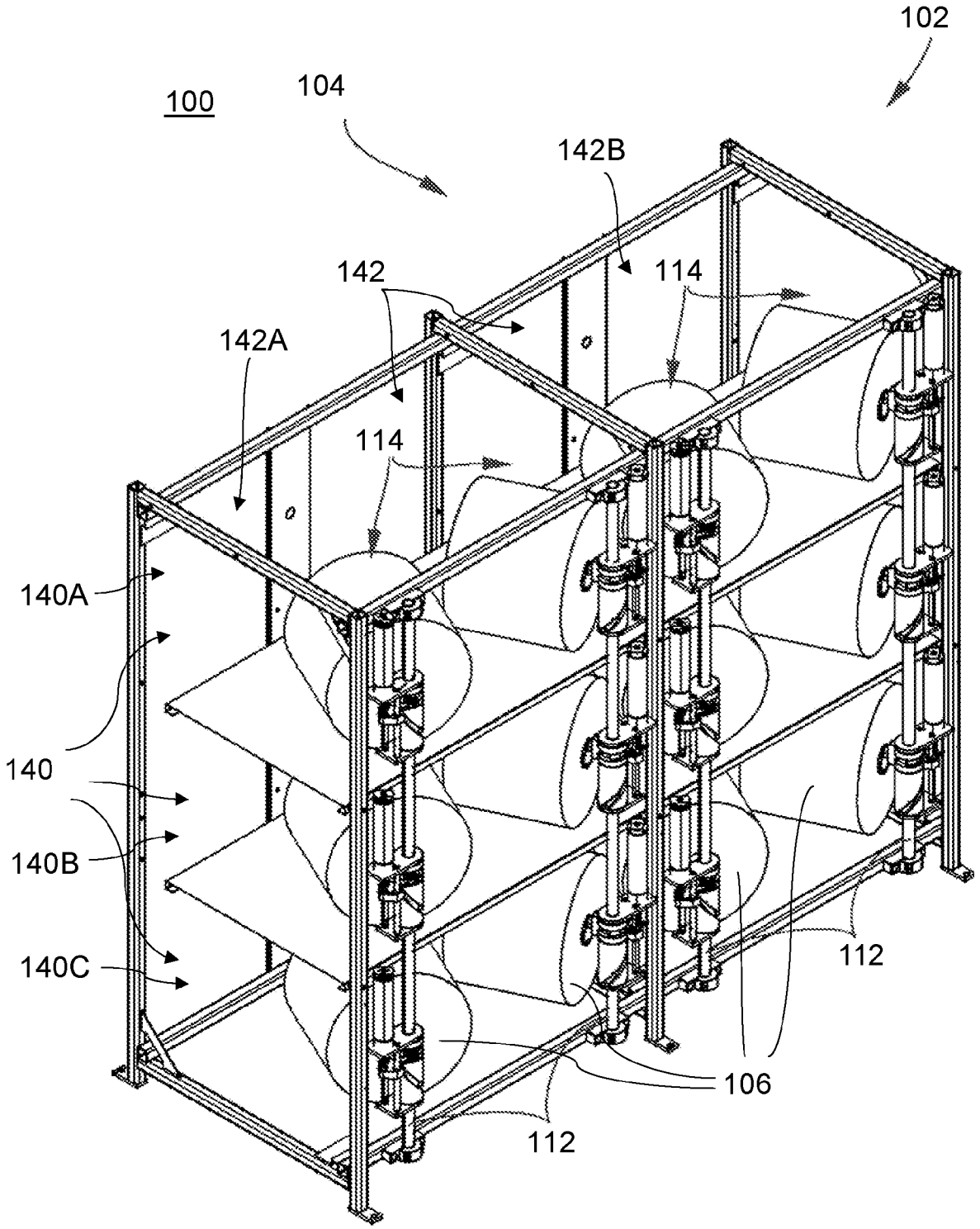
FIG. 2 depicts a rear elevational view of an example environment of a creel system that includes receiver apparatuses for yarn packages, according to one embodiment.
Figure 3:
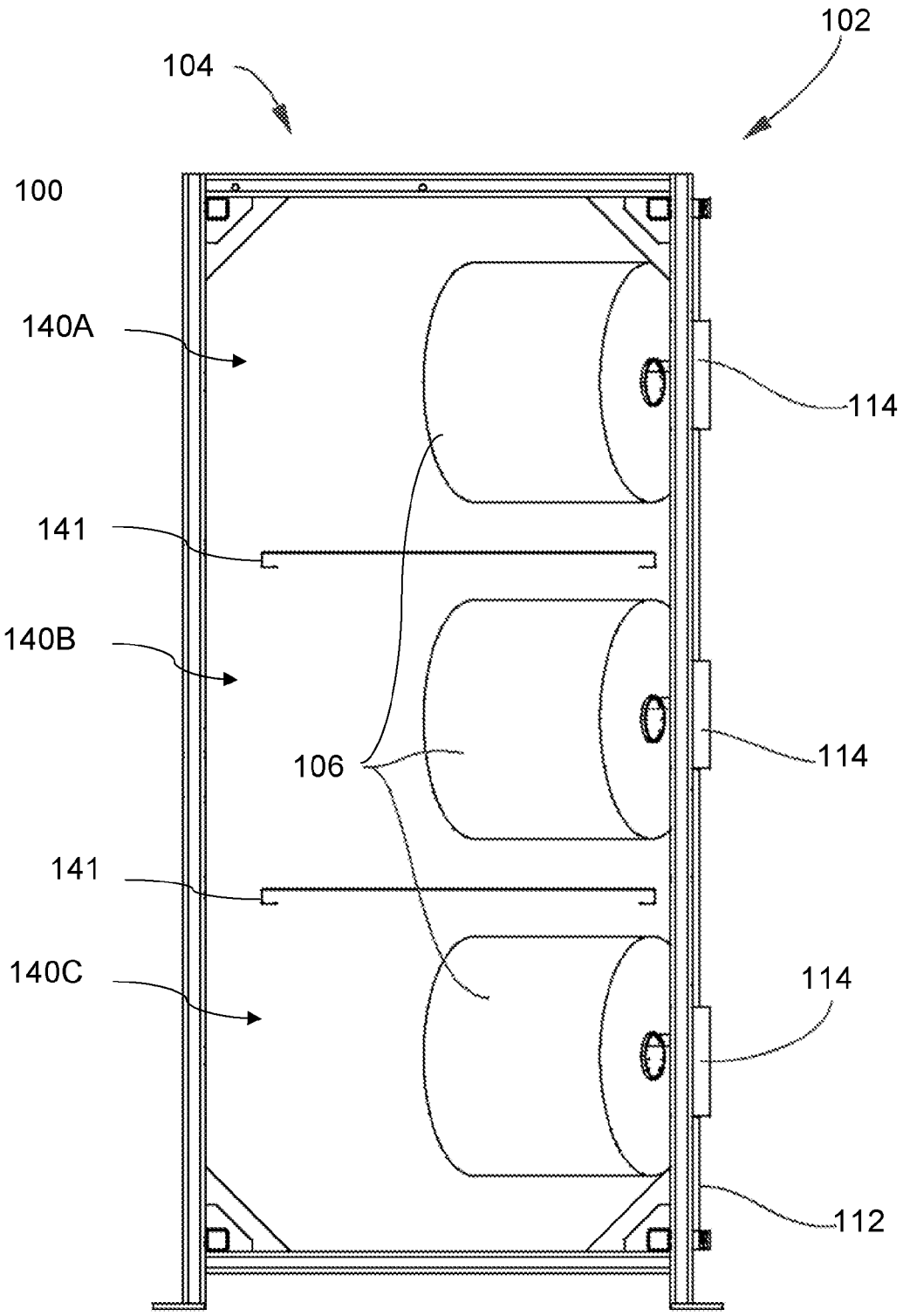
FIG. 3 depicts a side perspective view of an example creel system that includes receiver apparatuses for yarn packages, according to one embodiment.
Figure 4A:
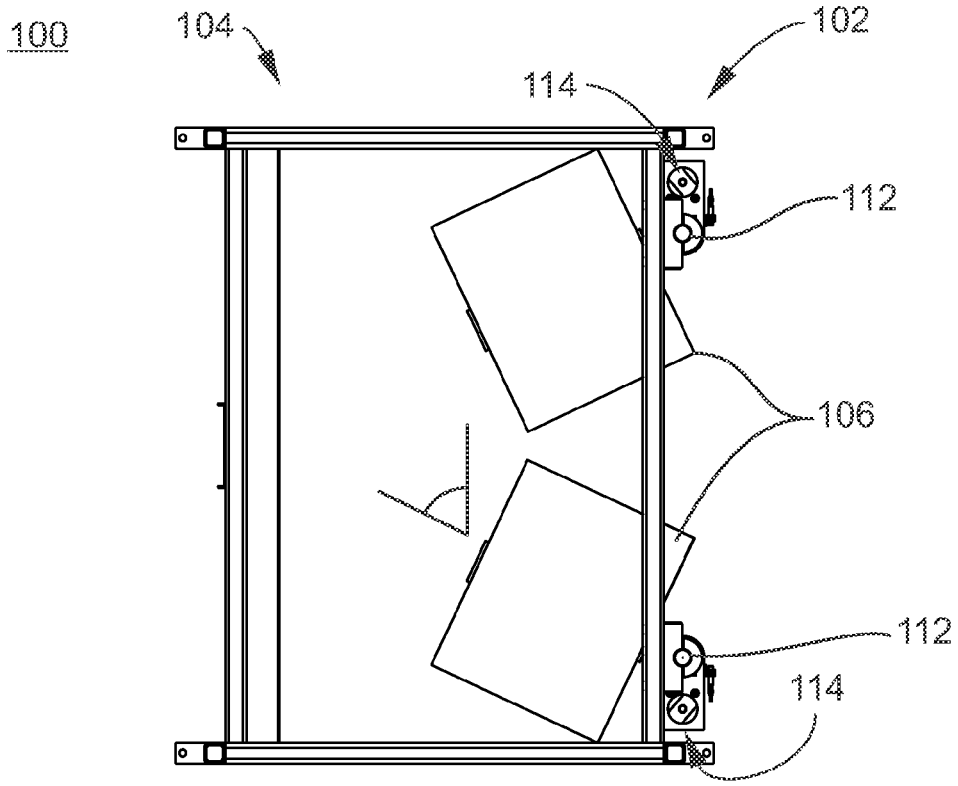
FIG. 4A depicts a top perspective view of a column of a creel system that includes receiver apparatuses for yarn packages, wherein the yarn packages are in the use position, according to one embodiment.
Figure 4B:
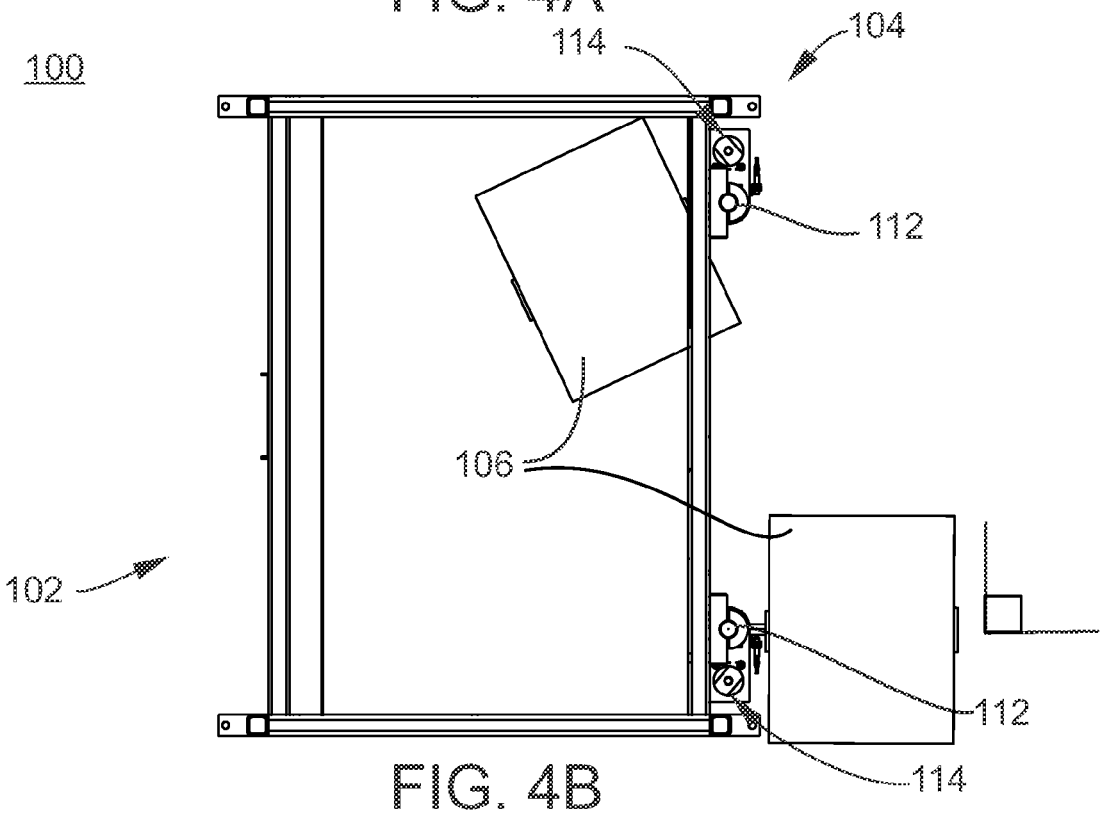
FIG. 4B depicts a top perspective view of the column of the creel system of FIG. 4A, wherein one of the yarn packages is in the load position and another yarn package is in in the use position, according to one embodiment.
Figure 5A:
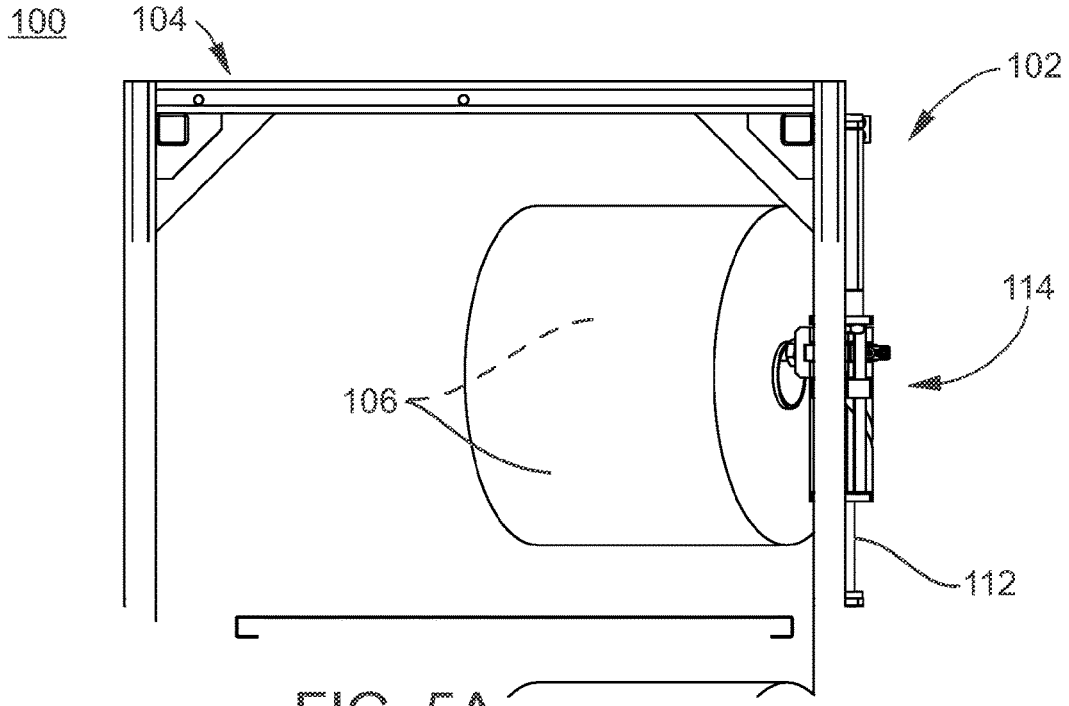
FIG. 5A depicts a side perspective view of a row of the creel system of FIGS. 4A-4B that includes receiver apparatuses for yarn packages, wherein the yarn packages are in the use position, according to one embodiment.
Figure 5B:
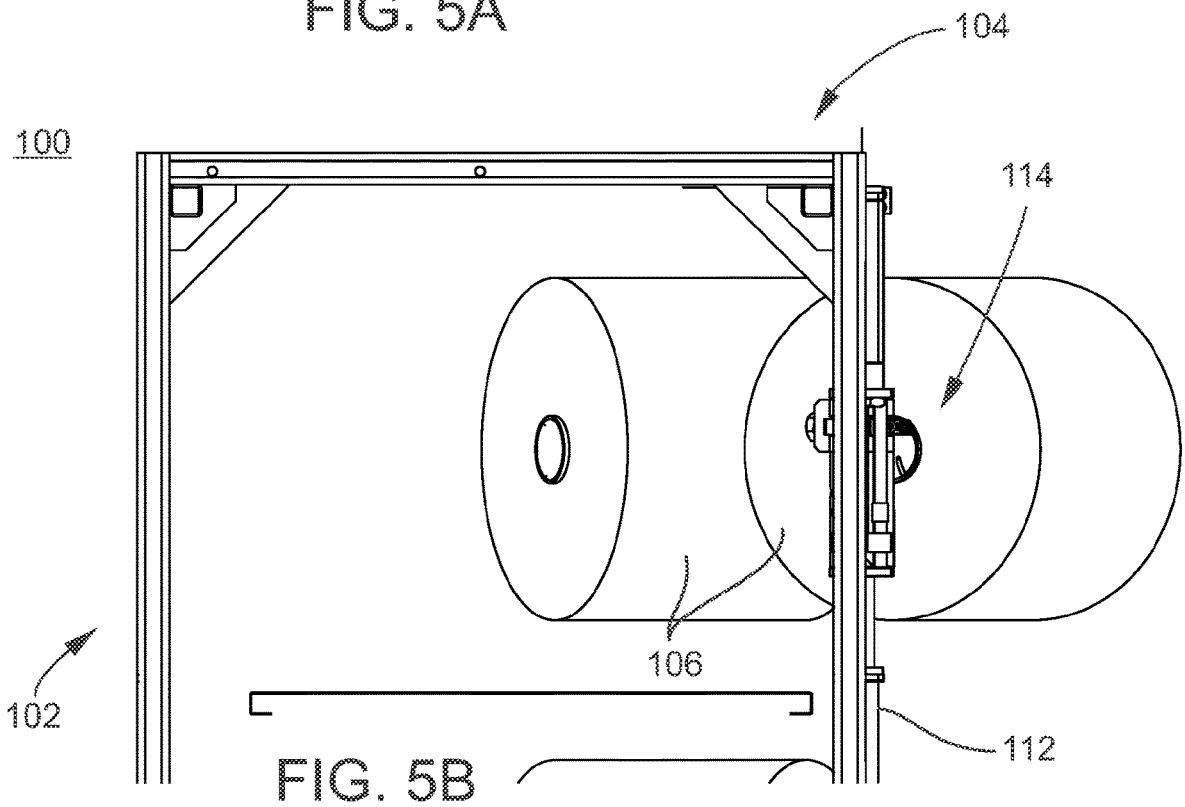
FIG. 5B depicts a side perspective view of the row of the creel system of FIGS. 4A-5A that includes receiver apparatuses for yarn packages, wherein one of the yarn packages is in the load position and another yarn package is in in the use position, according to one embodiment.
Figure 6A:
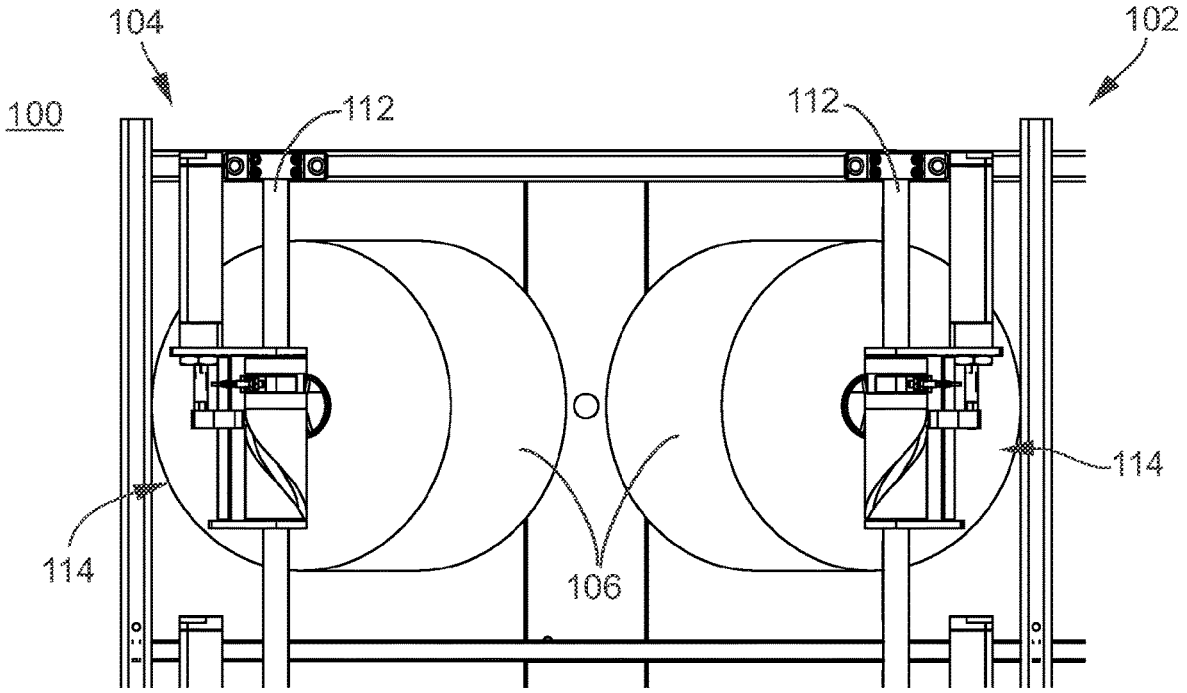
FIG. 6A depicts a rear perspective view of the row of the creel system of FIGS. 4A-5B that includes receiver apparatuses for yarn packages, wherein the yarn packages are in the use position, according to one embodiment.
Figure 6B:
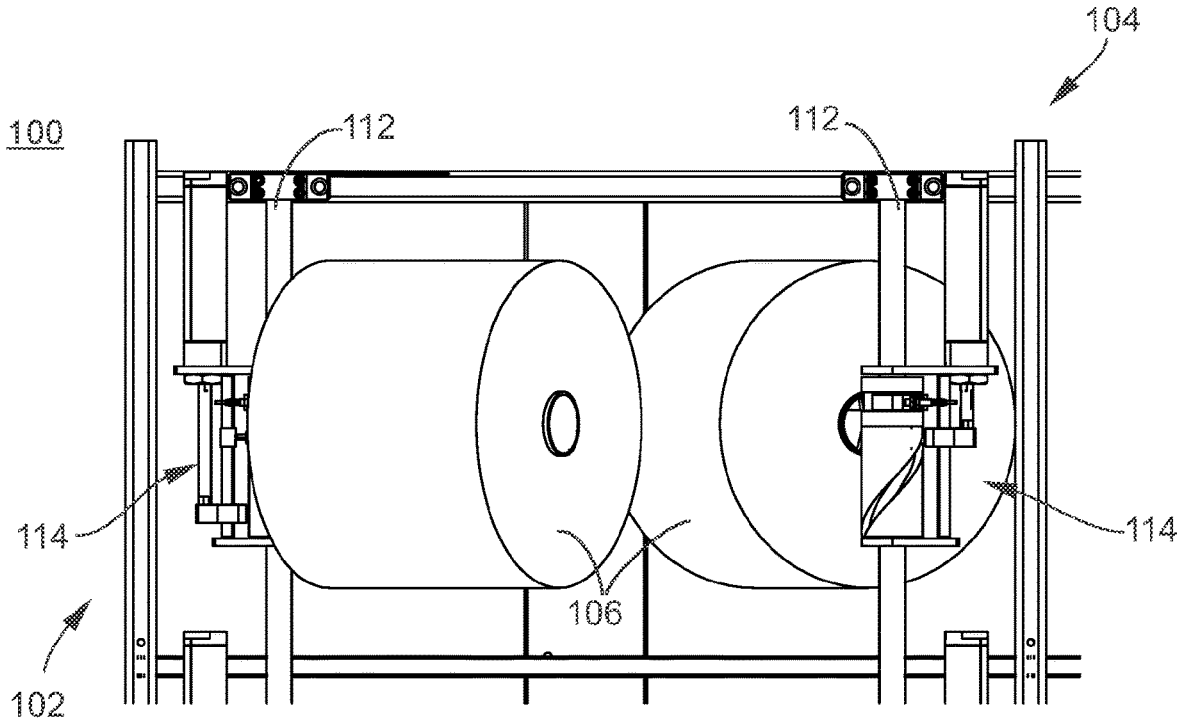
FIG. 6B depicts a rear perspective view of the row of the creel system of FIGS. 4A-6A that includes receiver apparatuses for yarn packages, wherein one of the yarn packages is in the load position and another yarn package is in in the use position, according to one embodiment.

For instance, and referring generally to FIGS. 1 through 10, exemplary embodiments of creel systems used for textiles such as carpets, rugs, matts, sheets, and the like are illustrated in accordance with aspects of the present disclosure (e.g., creel system 102). FIGS. 1 and 2 depict an example environment 100 of a creel system 102 that includes one or more receiver apparatuses 114 for a yarn package, according to one embodiment. In particular, as depicted in FIG. 1, the creel system 102 includes a frame 104 to support a plurality of receiver apparatuses 114 that are sized and shaped or otherwise configured to receive one or more yarn packages 106. As a non-limiting example, the creel system 102 may be configured such that there are multiple rows 140, each respective row 140 including one or more receiver apparatuses 114 associated therewith that are configured to retain a respective yarn package 106. In some embodiments the frame 104 may be configured as a layered rack where the rows 140 each comprise a layer of the rack (e.g., row 140A, row 140B, and row 140C) and are vertically stacked such that multiple yarn packages 106 are positioned within each layer of the rack. In some embodiments, each row 140 is separated by a separator 141 (see FIG. 3). Additionally, or alternatively, and as depicted in FIG. 2, the compartments 140 may form multiple adjoining columns 142. For instance, each row 140 may comprise a respective layer of the rack and each layer may include multiple columns (e.g., column 142A and column 142B) that are adjacently positioned one next to the other. One embodiment of a yarn package 106 suitable for use with the creel system 102 may include a hollow core with yarn 110 wrapped around the core. For example, the core of the yarn package (s) 106 may be configured as a hollow cylinder (e.g., a cardboard tube) around which the yarn 110 is wound. In some embodiments, the core may optionally include spool caps (e.g., core plugs, spool flange, etc.) positioned at one or more ends of the cylindrical core. The inside of the hollow core may generally be operable with the creel system 102 (or a portion of the creel system 102, e.g., a receiver as described below). As depicted, the hollow core may define a cylinder or the like of a constant or near constant diameter along a length of the hollow core. However, it should be appreciated that additional or alternative embodiments of the core may define a diameter that transitions along the length (e.g., a continuous reduction in diameter and/or two or more discrete portions of the length of the core may define different diameters).

In various embodiments, the creel system 102 may be configured to support a plurality of yarn packages 106 arranged in rows 140 and columns 142, e.g., a grid, and/or an arrangement suitable for the environment of the particular system. It should be appreciated that the creel system 102 may be configured to support as many yarn packages 106 as desired or required on a single frame 104 or multiple frames 104, such as 12 or more, 24 or more, 48 or more, 96 or more, etc. yarn packages 106. Further, the arrangement of frames 104 of the creel system 102 may take on various alternative forms and configurations suitable for the particular textile application and the environment of the creel system 102, e.g., due to spatial restrictions. For example and in various embodiments, the frame 104 may be configured as a segmented frame, an arrangement of abutting and/or stacked frames (e.g., a wall, stack, or the like), or another arrangement of frames 104 suitable for the environment 100 of the creel system 102 (e.g., aisles arranged between stacks of frames 104 of one or more creel systems 102).

In various embodiments, the frame 104 includes a plurality of frame members (e.g., see the frame members 108 in FIG. 1). The frame members 108 may generally support components of the creel system 102 (e.g., the yarn packages 106, receiver apparatuses 114, and associated components of the creel system 102). In some embodiments and as depicted in FIG. 1, one or more frame members 108 may be configured to orient one or more lines of yarn (yarn 110 illustrated in FIG. 1) for use in a suitable textile process. For instance, a portion of the frame members 108 may include one or more holes, slots, apertures, or the like configured to receive an associated yarn 110 and orient the yarn 110 at a height suitable for the textile process and/or prevent excessive translation of the associated yarn 110 during use. It should be appreciated that other embodiments and configurations of a frame may occur to one having ordinary skill in the art, and the present disclosure is equally applicable to any such frame suitable for use with a creel system as described herein.

FIGS. 4A-6B depict several views of a creel system 102 that includes receiver apparatuses 114 for yarn packages 106. As shown, the creel system 102 includes one or more posts 112 (e.g., an axle, rod, beam, or the like) supported at least partially relative to the frame 104. The creel system 102 may generally define an axis of rotation for each post 112 about which one or more yarn packages 106 associated with the post 112 may be rotated from a use position (see, e.g., FIGS. 1, 2, 3, 4A, 5A, 6A, 9A, and 10A) to a load position (see, e.g., FIGS. 4B, 5B, 6B, 9B, and 10B). For example, multiple yarn packages 106 arranged in a column (e.g., columns 142) may be rotated about the same post 112 or segments of a post 112 arranged end to end or with spaces therebetween. Thus, the axis of rotation may generally be aligned along a vertical direction. However, it should be appreciated that the axis of rotation may define a small angle with respect to the vertical direction up to and including a perpendicular angle relative to the vertical direction.

As shown, the creel system 102 generally includes a receiver for each yarn package 106 (up to the maximum number of yarn packages 106 intended for the creel system 102). The receiver is generally configured to receive a yarn package 106 and support the same while used in a textile process. For example, the yarn package 106 may be configured as a yarn spool. One or more of the receivers of the creel system 102 (such as all of the receivers) may be configured as a receiver apparatus 114. The receiver apparatus 114 is configured to retain a yarn package 106 and rotate the same between the use position (see, e.g., FIGS. 1, 2, 3, 4A, 5A, 6A, 9A, and 10A) and the load position (see, e.g., FIGS. 4B, 5B, 6B, 9B, and 10B) under power of the creel system 102 (e.g., without the need for an operator to manually power the rotation).

As shown particularly with respect to FIGS. 7-10B, each receiver apparatus 114 may include one or more support braces 116, a stator element 118, a rotor element 120, and an actuator 122. Each support brace 116 may be coupled between the frame 104 and an associated receiver apparatus 114 such that the receiver apparatus 114 is supported relative to the frame 104. In addition, each receiver apparatus 114 may include a receiver arm 132 that is operatively coupled to the rotor element 120 and is configured to pass through the hollow core of a yarn package (see FIGS. 1-6B and FIGS. 10A-10B).

As shown, one exemplary embodiment of a support brace 116 may include a bracket or the like coupled between the frame 104 and one or more of the stator element 118, the rotor element 120, and the post 112. The actuator 122 may be at least partially independently supported relative to the frame 104, as shown. However, it should be appreciated that, in other embodiments, the actuator 122 may be coupled between the stator element 118 and the rotor element 120 such that the actuator 122 is partially or fully supported relative to the frame 104 by the support brace 116.

In some embodiments and as shown, each support brace 116 may define an opening configured to receive an associated post 112 of the creel system 102, e.g., the illustrated post 112 is fully circumscribed by the openings of the associated support braces 116. However, it should be appreciated that, in other embodiments, the support brace 116 may not fully circumscribe the post 112 (e.g., a clamp or the like).

In the depicted embodiments, the receiver apparatus 114 includes two braces 116 secured above and below, respectively, the stator element 118 and the rotor element 120. As such, the support braces 116 may at least partially secure a desired orientation of the post 112 (e.g., generally along the vertical direction). In additional or alternative embodiments, one or more receiver apparatuses 114 may include only one support brace 116 or more than two support braces 116. Furthermore, the support brace(s) 116 may be positioned and oriented at suitable locations to support and/or fix one or more of the stator element 118, the rotor element 120, the actuator, 122 and/or the post 112.

As shown, the stator element 118 is coupled to at least one of the support braces 116 such that the stator element 118 is rotationally fixed relative to the axis of rotation, e.g., the vertical direction or along an axis of the post 112. For instance and as shown, the stator element 118 may include tabs or the like operable with cavities of the support brace 116, or vice versa. In some embodiments and as illustrated, the stator element 118 may translate in at least one direction relative to the frame 104, support brace(s) 116, and/or the rotor element 120. In various embodiments, the receiver apparatus 114 may be configured such that translation of the stator element 118 relative to the axis of rotation (e.g., along the axis of rotation and/or normal to the axis of rotation) causes rotation of the rotor element 120 about the post 112 and/or axis of rotation.

Figure 7:
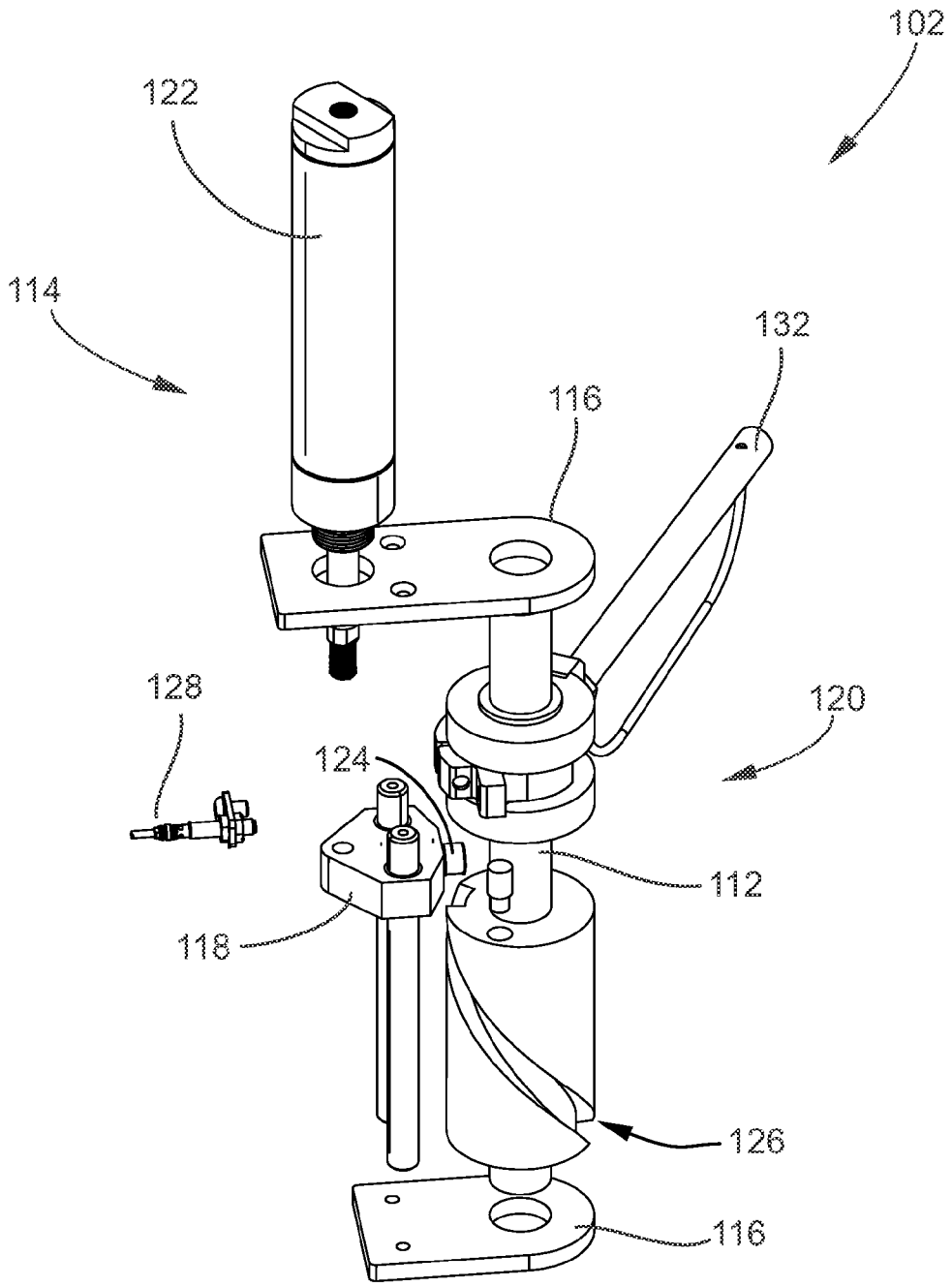
FIG. 7 depicts an elevated exploded view of a receiver apparatus for a creel system, according to one embodiment.
Figure 8:
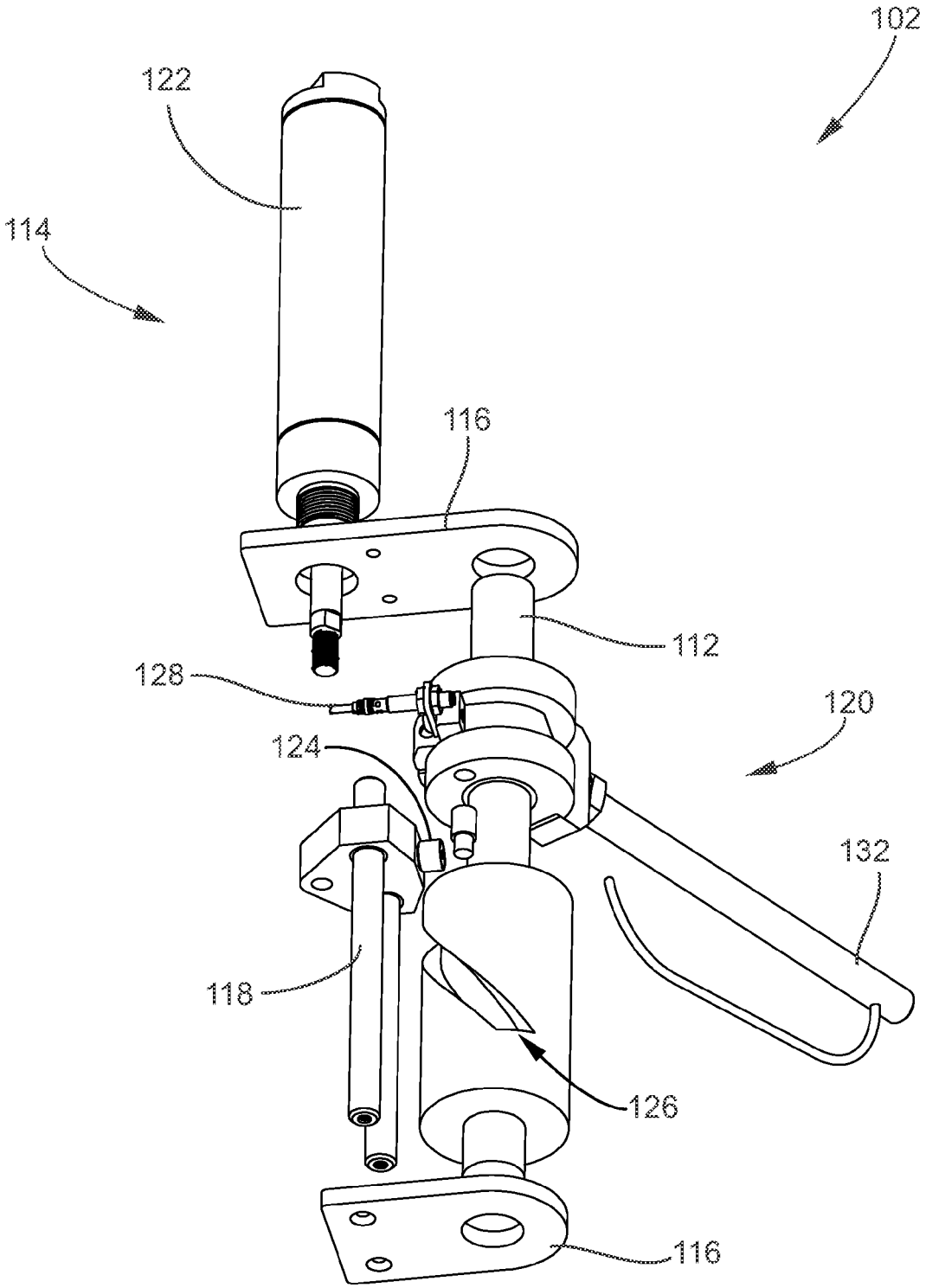
FIG. 8 depicts a bottom exploded view of the receiver apparatus of FIG. 7, according to one embodiment.
Figure 9A:
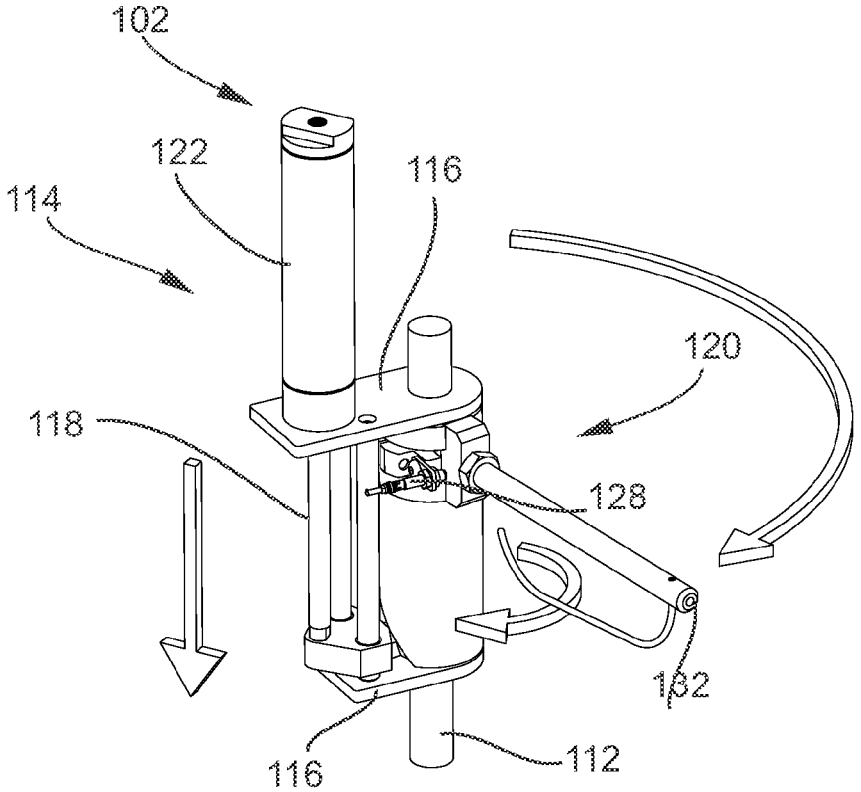
FIG. 9A depicts a perspective view of a receiver apparatus for a yarn package, wherein the receiver arm is in the use position, according to one embodiment.
Figure 9B:
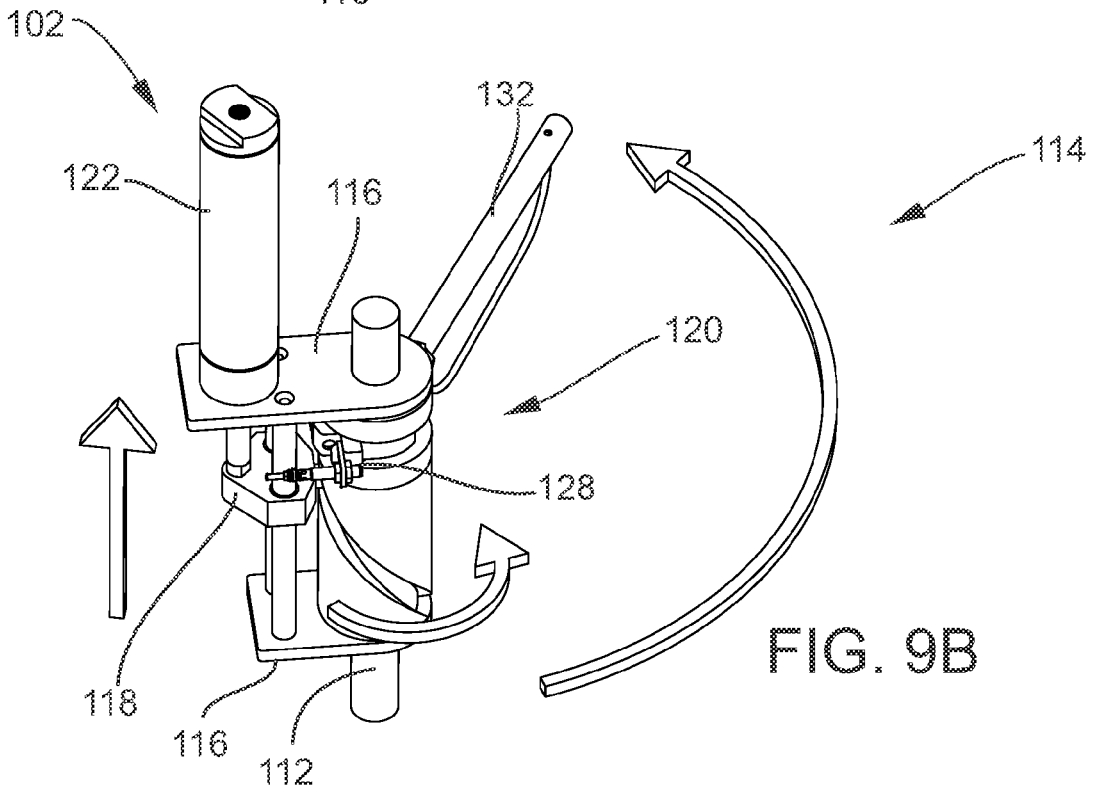
FIG. 9B depicts an elevated perspective view of the receiver apparatus of FIG. 9A, wherein the receiver arm is in the load position, according to one embodiment.
Figure 10A:
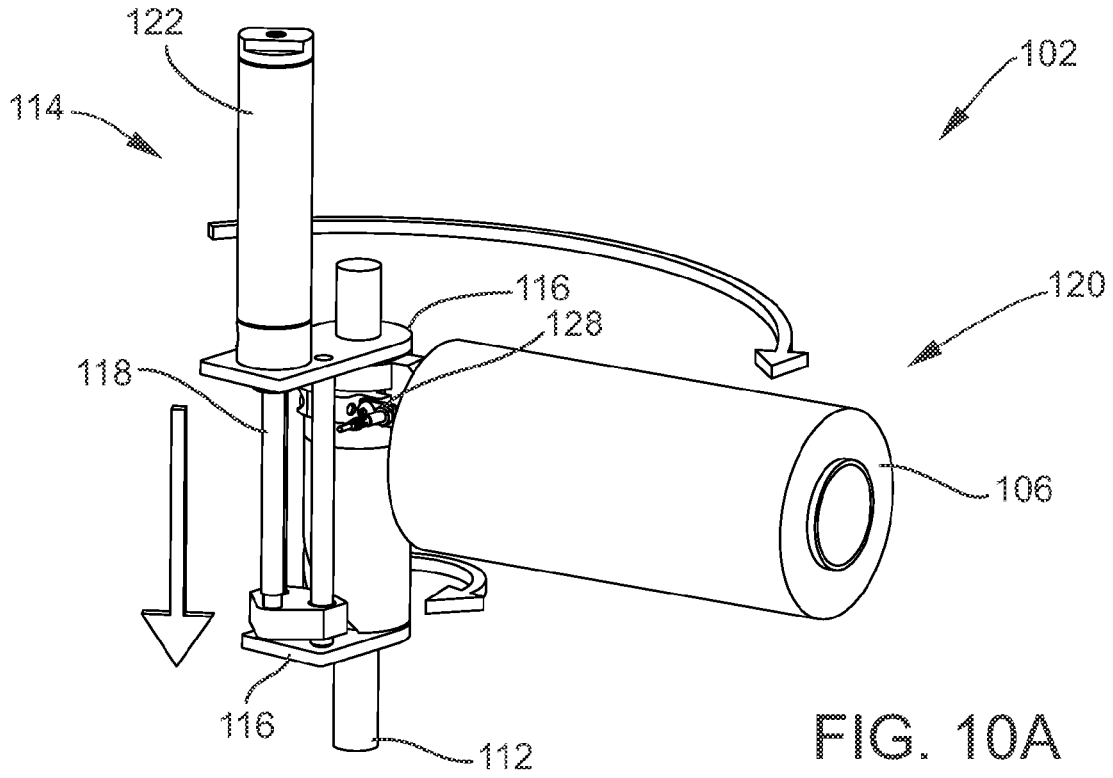
FIG. 10A depicts a perspective view of a receiver apparatus that includes a yarn package loaded thereon, wherein the receiver apparatus is in the use position, according to one embodiment.
Figure 10B:
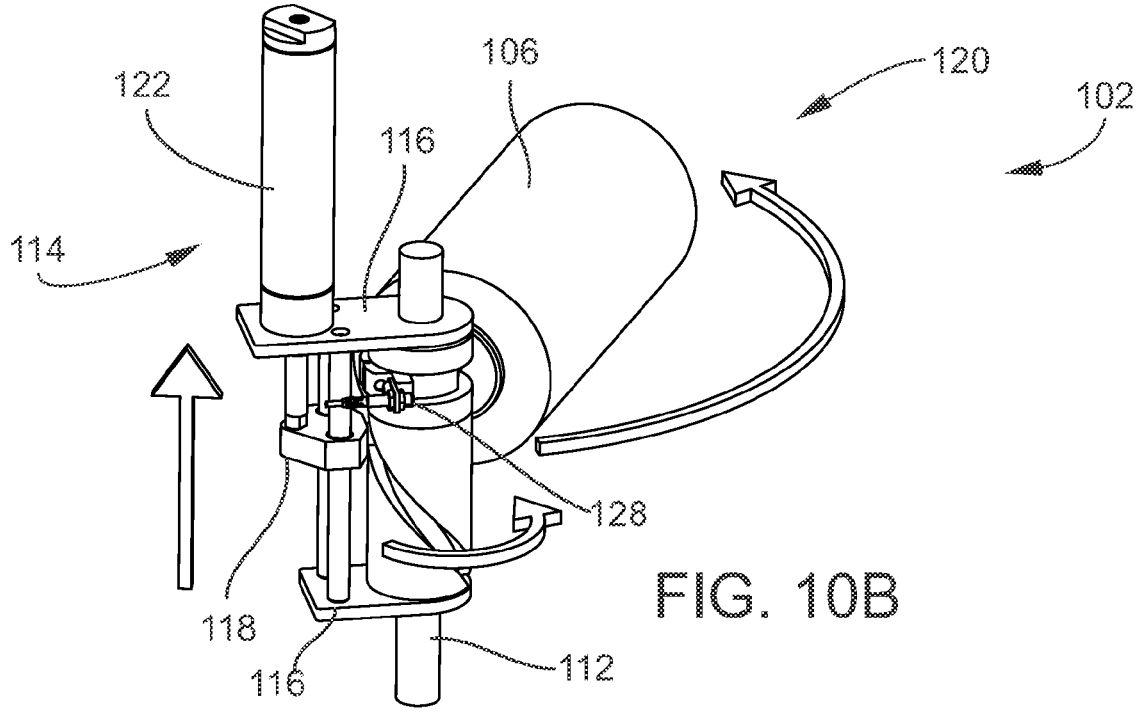
FIG. 10B depicts an elevated perspective view of the receiver apparatus of FIG. 10A that includes the yarn package loaded thereon, wherein the receiver apparatus is in the load position, according to one embodiment.

For example and as shown in FIGS. 7-10B, translation of the stator element 118 in one direction (e.g., downward) may cause the rotor element 120 to bias toward the load position, and translation of the stator element 118 in another direction (e.g., upward) may cause the rotor element 120 to bias toward the use position. As shown in FIGS. 7 and 8, the stator element 118 may include a key mechanism 124 operable with a guide channel 126 of the rotor element 122. For example, the key mechanism 124 may be configured as a cam follower included or associated with the stator element 118, and the guide channel 126 may be configured as a track, guide, or the like in a cam included or associated with the rotor element 120 and operable with cam track. As such, translation of the stator element 118 causes rotation of the rotor element 120. However, a person having ordinary skill in the art will appreciate that alternative arrangements of the rotor and stator are contemplated (e.g., an oppositely oriented guide channel). Furthermore, some embodiments of the stator element 118 may be configured to allow for rotation of the rotor element 120 without translation of the stator element 118.

The rotor element 120 is configured to rotate relative to the post 112, the stator element 118, and/or the axis of rotation. The rotor element 120 generally includes a base and a package holder extending from the base. The base is generally operable with the stator element 118 in order to allow for rotation therebetween (e.g., the base includes a guide channel in the depicted embodiments). For example, the base of the rotor element 120 may include one or more collars rotationally fixed relative to one another and the package holder such that the package holder rotates with the base. The rotor element 120 and/or stator element 118 may include one or more stops in order to set the maximum degree of rotation of the receiver apparatus 114 (e.g., the run position and the load position). As shown with respect to FIG. 7 and in some embodiments, the guide channel 126 may extend a full length of a cam, collar, or the like associated with the rotor element 120. Thus, the maximum degree of rotation of the creel system 102, within use, may be set by the position of the one or more stops and the length of the cam and guide channel (based on the degree of twist in the guide channel 126 along the axis of rotation). Additionally or alternatively and as shown in FIG. 8, the cam may define a guide channel 126 that extends along a portion of the length of the cam, e.g., less than the total length. For instance, the guide channel 126 may stop short before the bottom of the cam such that a portion of the bottom of the cam includes a full circumference, perimeter, or the like. It should be appreciated that the guide channel 126 may alternatively or additionally stop short before the top of the cam. Thus, the length of the guide channel 126 along the axis of rotation relative to the length of the cam may set the minimum and maximum rotational positions of the package receiver 114 of the creel system 102 (e.g., the maximum position any related stops may be set to).

As shown, the package holder of the rotor element 120 includes a proximal end coupled to the base, an elongated body extending at least partially radially, such as mostly radially, with respect to the post 112 to a distal end. In various embodiments, the elongated body 104 extends partially axially and/or upward to retain an associate yarn package 106. Additionally or alternatively, the package holder may include a retention device to secure the yarn package 106 to the receiver apparatus 114. For example, the yarn package 106 may be secured utilizing friction or an end retaining piece, such as a screw cap.

In some embodiments, the actuator 122 may include a hydraulic or pneumatic cylinder configured to translate the stator element 118, such as up and down vertically along the post 112 and/or axis of rotation. In the illustrated embodiment, a distal end of a cylinder is coupled to the top of the stator element 118 and a base end is fixed relative to the frame 104 and/or the support brace(s) 116. Thus, extension of cylinder causes the rotor element 120 to bias toward the load position, as described above. It should be appreciated that other embodiments of a cylinder are contemplated, and the present disclosure is equally applicable to any suitable configuration of a cylinder. For example, the distal end of the cylinder may be arranged below the stator element and coupled to the stator element 118 such that extension of the cylinder causes the rotor element 120 to bias toward the use position.

It should also be appreciated that various embodiments of the receiver apparatus 114 may include additional or alternative configurations of the stator element 118, the rotor element 120, and the actuator 122. For example, the actuator 122 may not include a cylinder but instead an electric actuator. Additionally or alternatively, other orientations of the cylinder are possible and one or more gear systems or the like may be used to change the orientation of provided rotation. In at least one embodiment, the stator element 118 may not include a key mechanism, and the rotor element 118 may not include guide channel. For example, a rotary actuator, electric motor, or the like may be configured to provide rotation between a fixed support brace 116 and/or stator element 118 and the package holder and/or rotor element 120.

Additionally or alternatively, the creel system 102 may include a user interface (e.g., a central user interface, a button, or a button for each receiver apparatus 114) configured to cause an associated receiver apparatus 114 to bias between the use position and the load position. For example, an activation signal (e.g., an electric signal, electrical power, pneumatic power, hydraulic power, or the like) may be communicated to the actuator 122 and cause rotation and/or pivoting of the rotor element 120, as described herein.

In additional or alternative embodiments, the creel system 102 may include one or more replacement sensors 128 (e.g., at least one replacement sensor 128 for each receiver apparatus 114 or each pair of operably associated receiver apparatuses 114) coupled to or supported relative to the frame 104. The replacement sensor(s) 128 are generally configured to communicate a signal indicative of a level of yarn remaining on one or more yarn packages 106 associated with the replacement sensor 128. Without limitation, suitable replacement sensors 128 for use with the creel system 102 may include proximity sensors, tension sensors, tension line sensors, radar sensors, laser sensors (e.g., ladar sensors), weight sensors, and the like. Additionally, or alternatively, the creel system 102 may include one or more replacement indicators (e.g., a replacement indicator for each receiver apparatus 114). For instance, each receiver apparatus 114 may be associated with a light (e.g., in close proximity or in a central control area) that may be illuminated or powered (e.g., receive a replacement signal) when a level of yarn remaining on the yarn package 106 on the receiver apparatus 114 falls below a predetermined level (e.g., empty or nearly empty, depleted, etc.). Thus, the creel system 102 may be configured to alert an operator when a yarn package 106 needs replaced. In some embodiments, the creel system 102 includes an auto-reloader system configured to remove an empty yarn package core from the package holder and load a new yarn package 106 on the package holder. For instance, the auto-reloader may include a robot configured to transport new yarn packages from a central location to the yarn package that needs replaced.

Additionally or alternatively, the creel system 102 may include a replacement sensor (see, e.g., sensor 128 illustrated in FIG. 1) suitable to determine that the creel system 102 has switched over from an empty first yarn package core 107 (e.g., the bottom, right yarn package 106 once the yarn wrapped around the spool has been depleted and leaves the empty core) to a new, second yarn package 109 (e.g., the bottom, left yarn package 106 with a full spool of yarn). In some embodiments, a replacement sensor 128 configured to determine that the first yarn package 107 is empty and/or that the creel system 102 has switched to feeding yarn 110 from the second yarn package 109 may include one or more of a motion sensors, load cells, mechanical drop wire switches, photoeyes, or the like suitable to detect the presence of the yarn 110 between adjacent, associated yarn packages 107, 109 and/or suitable to detect the transition from feeding yarn 110 from the first yarn package 107 to the second yarn package 109. Once feeding the yarn 110 has transitioned to the second yarn package 109, the actuator 122 may be powered in order to transition the empty first yarn package core 107 to the load position. Subsequently, an operator and/or the auto-loader system may pull the empty first yarn package core 107 from the package holder, load a new yarn package 106 on the package holder, and/or transport the used first yarn package core 109 to a disposal site. In some embodiments, the auto-loader system may be activated when the creel system 102 generates the replacement signal (e.g., from a replacement sensor 128) indicating that the first yarn package 107 is near empty, depleted, or the like in order to allow the auto-loader system to prepare to remove the first yarn package 107, such as to position the autoloader system or a component thereof and a new yarn package 106 in the vicinity of the first yarn package 107. Additionally or alternatively, the auto-loader system may be configured to replace the empty first yarn package core 107 when the creel system 102 generates the replacement signal indicating that feeding yarn has transitioned to the second yarn package 109

(such as replacement sensor 128). It should be appreciated that the replacement sensor 128 to determine that a yarn package is nearly empty and the replacement sensor 128 to determine if the yarn package is empty and/or that feeding yarn has been transitioned to the second yarn package 109 may be the same sensor, separate sensors, or a system of sensors. Additionally, a replacement sensor 128 as described herein may be associated with one or more of the receiver apparatuses 114. For example, two receiver apparatuses 114 that are operable to transition yarn 110 therebetween may be associated with a single replacement sensor or replacement sensor system. In some embodiments, each pair of operably associated receiver apparatuses 114 may be associated with a replacement sensor 128 or replacement sensor system. In additional or alternative embodiments, one or more receiver apparatuses 114 may be associated with its own, dedicated replacement sensor 128 or replacement sensor system, such as each receiver apparatus 114 of the creel system 102.

In some embodiments, the creel system 102 may include a controller communicatively coupled to the actuator 122, the replacement sensor(s) 128, the replacement indicator, and/or the auto-reloader for each receiver apparatus 114. For instance, the controller may be configured to automatically control operation of the actuator(s) 122, the replacement indicator, and/or the auto-reloader system based on the level of yarn remaining on the yarn package(s) 106. For example, the replacement sensor 128 may communicate a signal to the controller indicative of the level of yarn remaining on the yarn package(s) 106. The controller may be configured to determine whether the level of yarn remaining on the yarn package(s) 106 has fallen below the predetermined level based on the signal communicated from the replacement sensor 128. Once the controller has determined that the level of yarn remaining on a yarn package 106 is less than the predetermined level, the controller may communicate the replacement signal to the replacement indicator, and communicate the replacement signal to the auto-loader system. Additionally or alternatively, the controller may be configured to determine whether feeding yarn 110 has transitioned from an empty yarn package spool to a new yarn package 106 (e.g., transition from feeding yarn from the first yarn package 107 to the second yarn package 109) and communicate the activation signal to the actuator 122 associated with the yarn package 106 to pivot or rotate the yarn package 106 to the load position. Additionally, or alternatively, the controller may be configured to communicate another activation signal to the actuator 122 based on an indicator that a new yarn package 106 has been loaded on the package holder in question. In some embodiments of the method, the auto-loader system may be configured to connect the yarn 110 from the new yarn package 106 to the second yarn package 109 currently in use based on an indicator that the new yarn package 106 has been loaded on the package holder in question. For instance, the exterior end of the yarn 110 of the new yarn package 106 may be coupled (e.g., spliced, ultrasonically bonded, glued, or the like) to the second yarn package 109 at or near an interior end of the second yarn package 109. Additionally or alternatively, the auto-loader system may be configured to determine whether the exterior end of the yarn 110 of the new yarn package 106 has been successfully coupled to the associated yarn package 106 of the creel system 102.

The controller may include a processor, such as a microprocessor, and a memory device. The controller may also include one or more storage devices and/or other suitable components. The processor may be used to execute software, such as software for controlling the operation of the replacement indicator, the actuator, the auto-loader, and so forth. Moreover, the processor may include multiple microprocessors, one or more "general-purpose" microprocessors, one or more special-purpose microprocessors, and/or one or more application specific integrated circuits (ASICS), or some combination thereof. For example, the processor may include one or more reduced instruction set (RISC) processors.

The memory device may include a volatile memory, such as random access memory (RAM), and/or a nonvolatile memory, such as read-only memory (ROM). The memory device may store a variety of information and may be used for various purposes. For example, the memory device may store processor-executable instructions (e.g., firmware or software) for the processor to execute, such as instructions for controlling the replacement indicator, the actuator, the auto-loader, and so forth. The storage device(s) (e.g., nonvolatile storage) may include ROM, flash memory, a hard drive, or any other suitable optical, magnetic, or solid-state storage medium, or a combination thereof. The storage device(s) may store data (e.g., threshold values, etc.), instructions (e.g., software or firmware for controlling the replacement indicator, the actuator, the auto-loader, etc.), and any other suitable data.

The present disclosure also relates to methods for restocking a package holder of a creel system, e.g., creel system 102 as described herein. The method may include determining, utilizing a controller, the level on yarn remaining on a yarn package. The method may include communicating a replacement signal to a replacement indicator when the level of yarn remaining on the yarn package falls below a predetermined level. The method may include the controller communicating an activation signal to the actuator 122 of an associated receiver apparatus 114 to bias the same toward a load position when the level of yarn remaining on the yarn package 106 falls below a predetermined level. The method may include communicating the replacement signal to an auto-loader system. The method may include an operator causing the activation signal to be communicated to the actuator 122 of the associated receiver apparatus 114 to bias the same toward a load position via the user interface. The method may include an operator removing an empty yarn package core from the receiver apparatus 114. The method may include the auto-loader removing the empty yarn package core from the receiver apparatus 114. The method may include the operator loading a new yarn package 106 on the receiver apparatus 114. The method may include the auto-loader loading a new yarn package 106 on the receiver apparatus 114. The method may include the operator causing the activation signal to be communicated to the actuator 122 of the associated receiver apparatus 114 to bias the new yarn package 106 toward the run position via the user interface. The method may include the controller communicating the activation signal to the actuator 122 of the associated receiver apparatus 114 to bias the new yarn package 106 toward the run position via the user interface based on an indication that a new yarn package 106 has been loaded on the receiver apparatus 114 in question.

The present disclosure is also related to retrofitting a creel system 102 to include powered rotation of receiver arms 132. The method may include removing manually operated receiver arms 132 from a creel system 102. The method may include installing one or more receiver apparatuses 114, replacement sensors 128, replacement indicators, or controllers as described herein.

As disclosed herein, a receiver apparatus (e.g., receiver apparatus 114) for a package (e.g., yarn package 106) may include at least one support brace (e.g., fixed support brace 116) where one or more of the at least one support brace define an opening, and where one or more of the at least one support brace is configured to support the receiver apparatus (e.g., receiver apparatus 114) relative to a frame (e.g., frame 104). The opening may be configured to receive a post (e.g., post 112) and orient the post generally along a vertical axis. The receiver apparatus also includes a stator element (e.g., stator element 118) coupled to the one or more braces of the at least one brace such that the stator element is rotationally fixed relative to the one or more braces of the at least one support brace about the vertical axis. In addition, the receiver apparatus includes a rotor element (e.g., rotor element 120) configured to pivot about the vertical axis, where the rotor element comprises a base and a package holder (e.g., receiver arm 132). The package holder includes a proximal end, a distal end, and an elongated body therebetween, where the proximal end is coupled to the base of the rotor element such that the elongated body extends at least partially in a radial direction relative to the vertical axis. The receiver apparatus also includes an actuator (e.g., actuator 122) that is configured to receive an activation signal and to pivot the rotor element relative to the stator element about the vertical axis in response to receiving the activation signal. Further, according to various embodiments, the actuator includes at least one of a pneumatic actuator, a hydraulic actuator, or an electric actuator. In some embodiments, a replacement sensor (e.g. replacement sensor 128) may be configured to detect a level of yarn remaining on the package (e.g., yarn package 106) and communicate a level signal associated with the level of yarn remaining on the yarn package or absence of yarn, where the yarn package is coupled to the package holder. In one example, the replacement sensor may be positioned such that the level of yarn is detected when the package holder is in a use position.

In some embodiments, the receiver apparatus further includes a controller communicatively coupled to a replacement sensor, where the controller is configured to receive a level signal communicated by the replacement sensor, where the level signal indicates or is otherwise associated with a level of yarn remaining on the yarn package. Based on receiving the level signal, the controller compares the level of yarn remaining on the yarn package to a predetermined level and communicates, based on the level of yarn remaining on the yarn package being determined to be below the predetermined level, a replacement signal. The replacement signal is communicated to a replacement indicator, where the replacement indicator is configured, in use, to transmit an alert that the level of yarn remaining on the yarn package has fallen below a predetermined level. The controller may also communicate an activation signal to the actuator to bias the package holder, and thereby bias the yarn package.

Disclosed herein is a creel system (e.g., creel system 102) utilized for supporting packages (e.g., yarn packages 106) and defining a vertical axis of rotation, where the creel system includes a frame (e.g., frame 104) that includes a plurality of frame members (e.g., frame members 108). The creel system also includes a post (e.g., post 112) that is retained relative to the frame, and also includes a receiver apparatus (e.g. receiver apparatus 114) that is configured to retain the package. The receiver apparatus includes at least one support brace (e.g., fixed support brace 116), where one or more of the at least one support brace is coupled to the frame such that the receiver apparatus is supported relative to the frame. The one or more braces of the at least one support brace define an opening circumscribing the post such that the post is generally oriented along the vertical axis. The receiver apparatus also includes a stator element (e.g., stator element 118) that is coupled to the one or more of the at least one support brace such that the stator element is rotationally fixed, relative to the at least one support brace, about the vertical axis. The receiver apparatus also includes a rotor element (e.g., rotor element 120) that is pivotable about the post and includes a base and a package holder (e.g., receiver arm 132). The package holder includes a proximal end, a distal end, and an elongated body positioned between the proximal end and the distal end. The proximal end of the package holder is coupled to the base of the receiver apparatus such that the elongated body extends at least partially in a radial direction relative to the vertical axis. The receiver apparatus also includes an actuator (e.g., actuator 122) that is configured to receive an activation signal and pivot the rotor element relative to the stator element about the vertical axis. According to various embodiments, the actuator includes at least one of a pneumatic actuator, a hydraulic actuator, or an electric actuator.

According to various embodiments, the package includes a yarn package, and the creel system further includes a replacement sensor (e.g. replacement sensor 128) coupled to the frame and configured, during use, to detect a level of yarn remaining on the yarn package. Further, the replacement sensor is configured to communicate a level signal that indicates or is otherwise associated with the level of yarn remaining on the yarn package when the yarn package is coupled to the package holder. In one embodiment, the creel system further includes a controller that is communicatively coupled to the replacement sensor, where the controller is configured, during use, to receive a level signal communicated by the replacement sensor, where the level signal indicates a level of yarn remaining on the yarn package, and based thereon the controller compares the level of yarn remaining on the yarn package to a predetermined level. The controller may be further configured to communicate, based on the level of yarn that remains on the yarn package being determined to be below the predetermined level, a replacement signal to a replacement indicator.

In various embodiments, the controller is communicatively coupled to the actuator and is configured, in use, to communicate an activation signal to the actuator to facilitate biasing a rotor element. A replacement indicator may additionally, or alternatively, be communicatively coupled to the controller, where the replacement indicator is configured, in use, to receive a replacement signal and based thereon to transmit an alert that provides an indication that the level of yarn remaining on the yarn package has fallen below the predetermined level.

Figure 11:
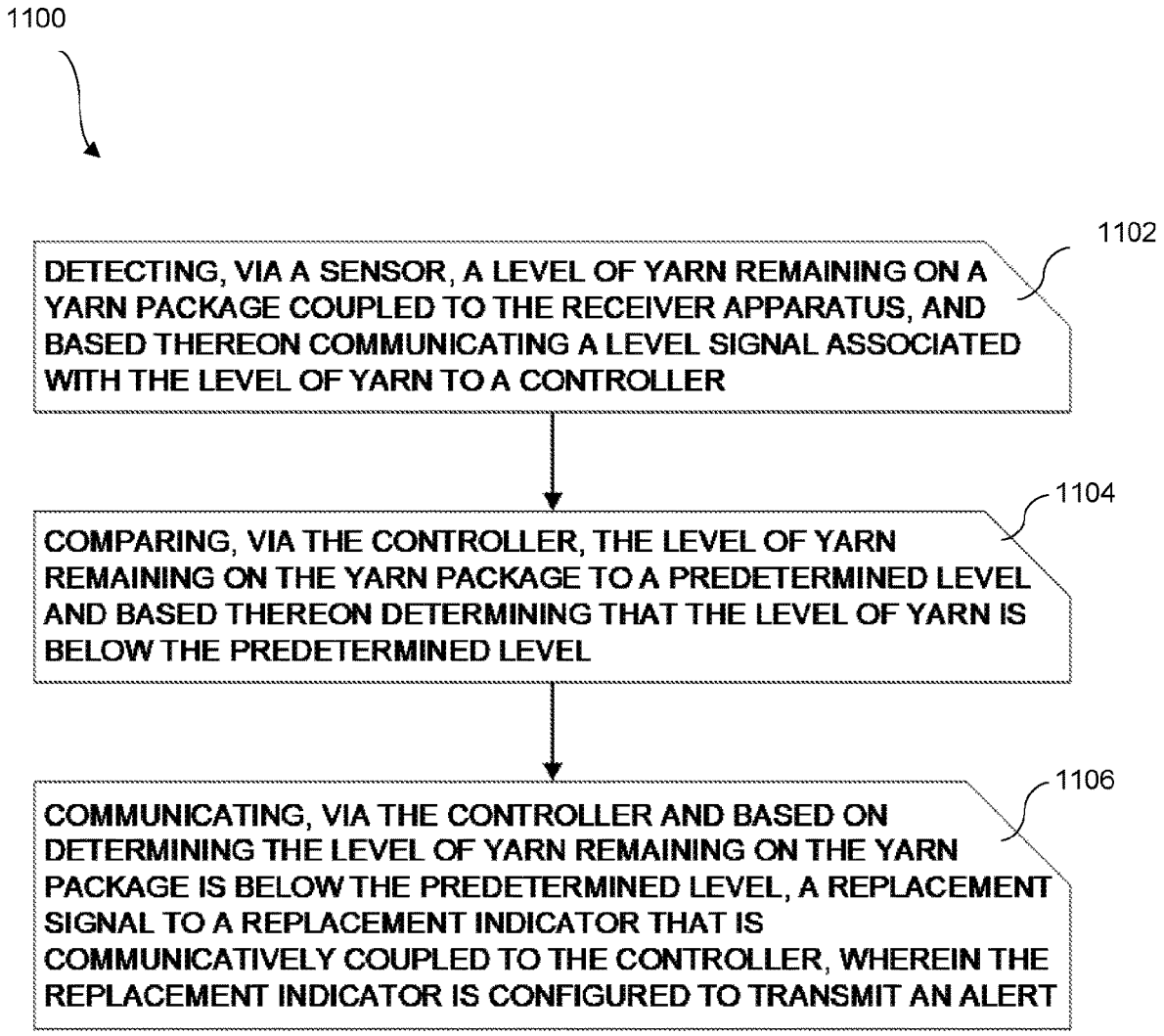
FIG. 11 depicts an example method for loading a creel system that includes one or more receiver apparatuses with one or more yarn packages, according to one embodiment.

FIG. 11 depicts an example method 1100 for using a receiver apparatus of a creel system. At block 1102, a level of yarn remaining on a yarn package coupled to the receiver apparatus is detected, via a sensor, and based thereon a level signal associated with the level of yarn is communicated to a controller. At block 1104, the level of yarn remaining on the yarn package is compared, via the controller, to a predetermined level (e.g., a threshold) and based thereon determining that the level of yarn is below the predetermined level. At block 1106, based on determining the level of yarn remaining on the yarn package is below the predetermined level, a replacement signal to a replacement indicator that is communicatively coupled to the controller, where the replacement indicator is configured to transmit an alert.

According to various embodiments, the method 1100 may also include additional processes that include transmitting, via the replacement indicator, the alert to an operator to remove a core of the yarn package from the receiver apparatus. In addition, a first input is received by the controller from an operator and based thereon a first activation signal is communicated to an actuator of the receiver apparatus to facilitate biasing a rotor element toward a load position. Further, in some embodiments, the controller may receive a second input from the operator, and based thereon a second activation signal is communicated to the actuator of the receiver apparatus to facilitate biasing the rotor element toward a use position, where the second input is received after the operator has coupled a new yarn package to the receiver apparatus.

The method 1100 may also include, in various embodiments, communicating, via a controller and based on the replacement indicator receiving the replacement signal, a first activation signal to an actuator of the receiver apparatus. Based on the actuator receiving the first activation signal, a stator element of the receiver apparatus is vertically translated in a first direction along an axis of rotation defined by the creel system, where the translating causes rotation of a rotor element that comprises a package holder. In particular, the rotor element rotates about a post from a use position to a load position, thereby biasing a package holder comprising an at least partially depleted yarn package from the use position to the load position.

The method 1100 may also include transmitting, via the replacement indicator the alert to an auto-loader system, where the auto-loader system is configured to remove the yarn package from the receiver apparatus and couple a new yarn package to the receiver apparatus. In addition, in some embodiments, the method 1100 includes removing, via an auto-loader system and based on the alert being transmitted to the auto-loader system and a rotor element biasing toward a load position, the yarn package coupled to the receiver apparatus. Further, a new yarn package may be loaded, via the auto-loader, onto the receiver apparatus. Based on the auto-loader loading a new yarn package onto the receiver apparatus, a second activation signal is communicated, via a controller, to an actuator of the receiver apparatus and a stator element of the receiver apparatus is vertically translated in a second direction along an axis of rotation defined by the creel system. Translation of the stator element causes rotation of a rotor element that includes a package holder to bias toward a use position, where the package holder is coupled to the new yarn package.

According to various embodiments, the method 1100 also includes vertically translating a stator element of the receiver apparatus along an axis of rotation defined by the creel system, the translating causing rotation of a rotor element that comprises a package holder. Further, translating the stator element in a first direction causes the rotor element to bias toward a load position, and wherein translating the stator element in a second direction opposite the first direction causes the rotor element to bias toward a use position.

The foregoing has described various embodiments of a creel system. While specific embodiments of the present invention have been described, it will be apparent to those skilled in the art that various modifications thereto can be made without departing from the spirit and scope of the invention. Accordingly, the foregoing description of the invention and the best mode for practicing the invention are provided for the purpose of illustration only and not for the purpose of limitation. It is envisioned that other embodiments may perform similar functions and/or achieve similar results. Any and all such equivalent embodiments and examples are intended to be within the scope of the claims if they include structural elements that do not differ from the literal language of the claims, or if they include equivalent structural elements with insubstantial differences from the literal languages of the claims.

What is claimed is:

1. A method of using a receiver apparatus of a creel system, the method comprising:

detecting, via a sensor, a level of yarn remaining on a yarn package coupled to the receiver apparatus, and based thereon communicating a level signal associated with the level of yarn to a controller;

comparing, via the controller, the level of yarn remaining on the yarn package to a predetermined level and based thereon determining that the level of yarn is below the predetermined level;

communicating, via the controller and based on determining the level of yarn remaining on the yarn package is below the predetermined level, a replacement signal to a replacement indicator that is communicatively coupled to the controller, wherein the replacement indicator is configured to transmit an alert; and vertically translating a stator element of the receiver apparatus along an axis of rotation defined by the creel system, the translating causing rotation of a rotor element that comprises a package holder.

2. The method of claim 1, wherein the method further comprises:

transmitting, via the replacement indicator, the alert to an operator to remove a core of the yarn package from the receiver apparatus; and receiving a first input from an operator and based thereon communicating a first activation signal to an actuator of the receiver apparatus to facilitate biasing a rotor element toward a load position.

3. The method of claim 1, wherein the method further comprises:

receiving a second input from an operator and based thereon communicating a second activation signal to an actuator of the receiver apparatus to facilitate biasing a rotor element toward a use position, wherein the input is received after the operator has coupled a new yarn package to the receiver apparatus.

4. The method of claim 1, wherein the method further comprises transmitting, via the replacement indicator, the alert to an auto-loader system, wherein the auto-loader system is configured to remove the yarn package from the receiver apparatus and couple a new yarn package to the receiver apparatus.

5. The method of claim 1, wherein the method further comprises:

removing, via an auto-loader system and based on the alert being transmitted to the auto-loader system and a rotor element biasing toward a load position, the yarn package coupled to the receiver apparatus; and loading, via the auto-loader, a new yarn package onto the receiver apparatus.

6. The method of claim 1, wherein vertically translating the stator element in a first direction causes the rotor element to bias toward a load position, and wherein vertically translating the stator element in a second direction opposite the first direction causes the rotor element to bias toward a use position.

7. A method of using a receiver apparatus of a creel system, the method comprising:

detecting, via a sensor, a level of yarn remaining on a yarn package coupled to the receiver apparatus, and based thereon communicating a level signal associated with the level of yarn to a controller;

comparing, via the controller, the level of yarn remaining on the yarn package to a predetermined level and based thereon determining that the level of yarn is below the predetermined level;

communicating, via the controller and based on determining the level of yarn remaining on the yarn package is below the predetermined level, a replacement signal to a replacement indicator that is communicatively coupled to the controller, wherein the replacement indicator is configured to transmit an alert:

communicating, via a controller and based on the replacement indicator receiving the replacement signal, a first activation signal to an actuator of the receiver apparatus; and vertically translating a stator element of the receiver apparatus in a first direction along an axis of rotation defined by the creel system, wherein vertically translating the stator element causes rotation of a rotor element that comprises a package holder, the rotor element rotating about a post from a use position to a load position thereby biasing the package holder from the use position to the load position.

8. A method of using a receiver apparatus of a creel system, the method comprising:

detecting, via a sensor, a level of yarn remaining on a yarn package coupled to the receiver apparatus, and based thereon communicating a level signal associated with the level of yarn to a controller;

comparing, via the controller, the level of yarn remaining on the yarn package to a predetermined level and based thereon determining that the level of yarn is below the predetermined level;

communicating, via the controller and based on determining the level of yarn remaining on the yarn package is below the predetermined level, a replacement signal to a replacement indicator that is communicatively coupled to the controller, wherein the replacement indicator is configured to transmit an alert;

based on an auto-loader loading a new yarn package onto the receiver apparatus, communicating, via a controller, a second activation signal to an actuator of the receiver apparatus; and vertically translating a stator element of the receiver apparatus in a second direction along an axis of rotation defined by the creel system, wherein vertically translating the stator element causes rotation of a rotor element that comprises a package holder to bias toward a use position, the package holder being coupled to the new yarn package.

* * * * *